US006554545B1

(12) United States Patent
Hall

(10) Patent No.: US 6,554,545 B1
(45) Date of Patent: Apr. 29, 2003

(54) FRAMEWORK AND METHOD OF FORMING A SUPPORT STRUCTURE WITH INTERLOCKING OF ADJACENT COMPARTMENTS

(76) Inventor: Alethea Rosalind Melanie Hall, Plot 40, Dawn Farm, Driefontein, 1747, Muldersdrift (ZA)

( * ) Notice: Subject to any disclaimer, the term of this patent is extended or adjusted under 35 U.S.C. 154(b) by 0 days.

(21) Appl. No.: 09/701,665

(22) PCT Filed: May 28, 1999

(86) PCT No.: PCT/IB99/00964

§ 371 (c)(1),
(2), (4) Date: Nov. 30, 2000

(87) PCT Pub. No.: WO99/63165

PCT Pub. Date: Dec. 9, 1999

(30) Foreign Application Priority Data

Jun. 1, 1998 (ZA) ..... 98/4685

(51) Int. Cl.[7] ..... E02B 3/04; E02D 3/00; B32B 3/12

(52) U.S. Cl. ..... 405/302.4; 405/15; 405/16; 405/258.1; 428/117; 428/179; 428/184

(58) Field of Search ..... 405/15–19, 258.1, 405/262, 272, 284, 286, 302.4, 302.6, 302.7; 428/116–118, 179, 180, 182, 184, 188, 194; 52/793.11, 799.11, 799.12

(56) References Cited

U.S. PATENT DOCUMENTS

| | | | | | |
|---|---|---|---|---|---|
| 1,586,326 | A | * | 5/1926 | Older | 404/51 |
| 3,484,835 | A | * | 12/1969 | Trounstine et al. | 428/179 |
| 3,785,741 | A | * | 1/1974 | Lodige | 404/51 |
| 3,911,187 | A | * | 10/1975 | Raley | 428/180 |
| 3,974,789 | A | * | 8/1976 | de Groot | 114/256 |
| 4,172,680 | A | * | 10/1979 | Brown | 405/16 |
| 4,333,979 | A | * | 6/1982 | Sciaraffa et al. | 428/182 X |
| 4,397,902 | A | * | 8/1983 | Resch | 428/119 |
| 4,717,283 | A | * | 1/1988 | Bach | 405/17 |
| 4,778,309 | A | * | 10/1988 | Bach et al. | 405/284 |
| 4,804,293 | A | * | 2/1989 | Varkonyi et al. | 405/15 |
| 4,965,097 | A | | 10/1990 | Bach | |
| 5,102,256 | A | * | 4/1992 | Gosnell | 404/40 |
| 5,201,154 | A | * | 4/1993 | Thomas | 52/102 |
| 5,449,543 | A | * | 9/1995 | Bach et al. | 405/258.1 X |
| 5,927,906 | A | * | 7/1999 | Bach et al. | 405/258.1 |
| D444,579 | S | * | 7/2001 | Emalfarb | D25/164 |
| 6,296,924 | B1 | * | 10/2001 | Bach | 405/16 X |
| 6,305,875 | B1 | * | 10/2001 | Matsumoto | 405/16 |

FOREIGN PATENT DOCUMENTS

| | | | | |
|---|---|---|---|---|
| EP | 0378309 | | 7/1990 | |
| EP | 559969 | * | 9/1993 | |
| EP | 0889173 | | 1/1999 | |
| GB | 2078833 | * | 1/1982 | 405/16 |
| WO | WO9716604 | | 5/1997 | |
| WO | WO9736057 | | 10/1997 | |

* cited by examiner

*Primary Examiner*—Jong-Suk (James) Lee
(74) *Attorney, Agent, or Firm*—Ladas & Parry

(57) ABSTRACT

A method of forming a support structure on a base from a framework uses a tube of a flexible material divided by dividing walls of flexible material into an array of compartments. Each compartment includes at least one wall including a hollow protrusion or recess. In use the framework is located on the base and the compartments are filled with the filler material so that each compartment is adjacent to one or more other compartments filled with the filler material and so that each hollow protrusion fills with the filler material so that each compartment protrudes into or is protruded into by at least one adjacent compartment so as to interlock adjacent compartment. This increases the overall strength of the support structure.

11 Claims, 3 Drawing Sheets

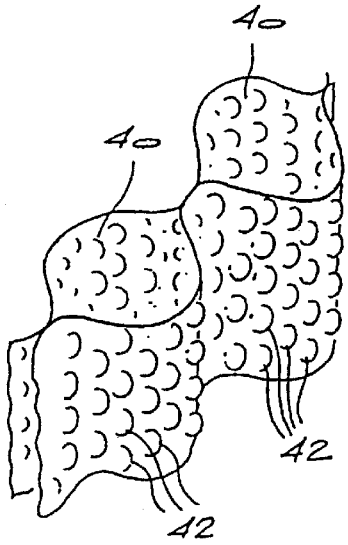
Fig 2
Fig 3a Fig 4a Fig 5a Fig 6a Fig 7a
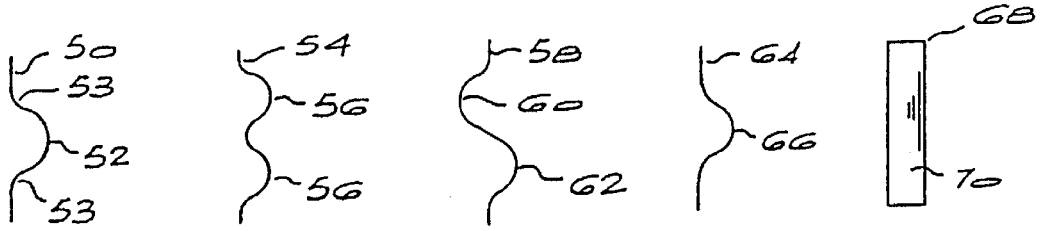
Fig 3b Fig 4b Fig 5b Fig 6b Fig 7b
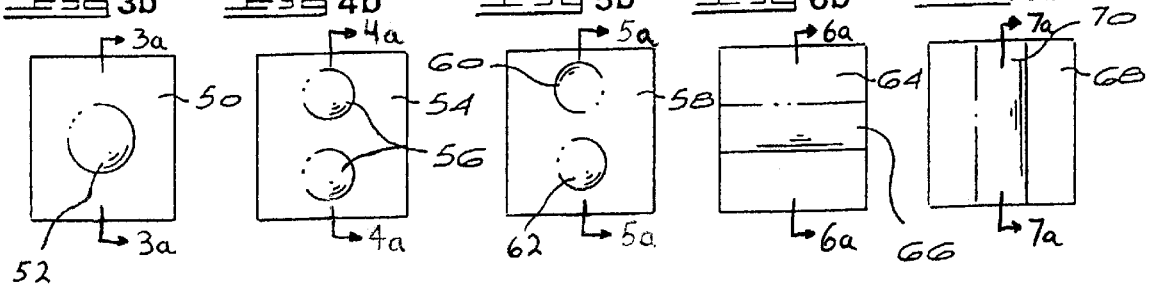

Fig 8a
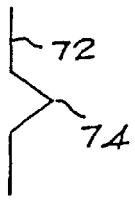
Fig 9a
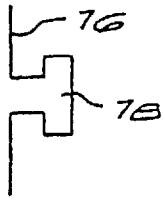
Fig 10a
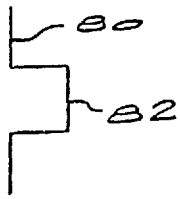
Fig 11a
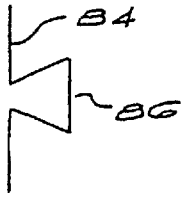
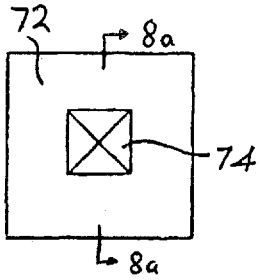
Fig 8b
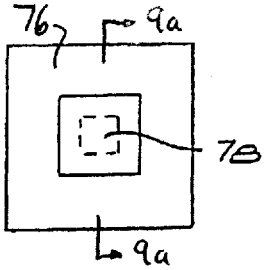
Fig 9b
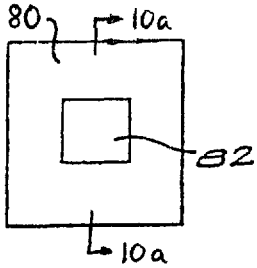
Fig 10b
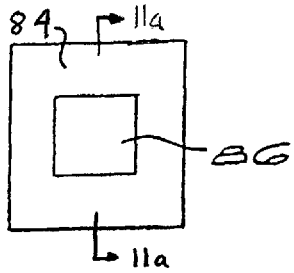
Fig 11b

FRAMEWORK AND METHOD OF FORMING A SUPPORT STRUCTURE WITH INTERLOCKING OF ADJACENT COMPARTMENTS

BACKGROUND OF THE INVENTION

This invention relates to a method of forming a support structure on a base, and to a framework for use in forming such a support structure.

It is well known to form support structures such as roadways, canal or river or bank linings, mine packs, sea walls or the like from a material having a honeycomb structure, i.e. having a plurality of compartments or cells divided by dividing walls, each compartment or cell being filled with a suitable filler material. Examples of such materials for use in these support structures are HYSON-CELLS from M&S Technical Consultants & Services (Pty) Limited, GEOWEB from Presto Products Co., Tenweb from Tenax Corp, ARMATER from Crow Company, TERRA-CELL FROM Webtec Inc., ENVIROGRID from Akzo Nobel Geosynthetics Co. and GEOCELLS from Kaytech.

In making a support structure using these materials, it has generally been the practice for the walls of the compartments to be substantially planar, i.e flat, in use. This has lead to the result that the filler material, particularly when it is cement based, in certain circumstances shrinks away from the walls of the compartments during use of the support structure, thus creating gaps in the support structure and reducing any support of one compartment by adjacent compartments. This in turn results in the support structure not being able to take as great a load as may be desired.

There is thus need for a method of overcoming this problem.

SUMMARY OF THE INVENTION

According to a first aspect of the invention there is provided a method of forming a support structure on a base from a framework comprising a tube of a flexible material divided by dividing walls of a flexible material into an array of compartments or cells running the length of the tube, the compartments being arranged in rows and columns so that the tube divided by dividing walls has a honeycomb structure, a wall or walls of each compartment including one or more hollow protrusions or one or more hollow recesses, or both, which method comprises the steps of:

(1) locating the framework on the base;

(2) filling the compartments with a filler material so that each compartment is adjacent to one or more other compartments filled with the filler material to support and be supported by the adjacent compartments, and so that each hollow protrusion in a compartment wall fills with the filler material so that each compartment protrudes into or is protruded into by at least one adjacent compartment so as to interlock adjacent compartments.

The protrusions or recesses must be of a size and shape to achieve interlocking of the filler material in one compartment with the filler material in an adjacent compartment, with the common wall between the compartment still separating the filler materials in the two compartments and thus acting as an expansion joint. In this way the overall strength of the support structure formed is increased, and there is also increased resistance against the filler material in one compartment being pushed or pulled out of that compartment.

The protrusion of one compartment into another adjacent compartment allows any load applied to the support structure to be transferred across the support structure, and thus assists in preventing fracture or disintegration of the support structure, which in turn allows the support structure to accept greater loads.

It is to be noted that a wall of a first compartment adjacent to a second compartment is also a wall of that second compartment, and thus that a protrusion in this wall of the first compartment equates to a recess in this wall of the second compartment.

As indicated above the protrusions or recesses may have any suitable shape, such as for example curved or rounded shapes, a dovetail shape, a T-shape, a block shape, or a pyramidal shape or the like.

For certain applications, where the support structure is intended to receive a load, the protrusions and recesses are curved or rounded so as to allow for a degree of rotation between adjacent compartments during filling and setting of the filler material, and to prevent any shearing of the protrusions from the remainder of the filler material in the relevant compartment on application of a load to the support structure.

When the protrusions and recesses are curved or rounded, each protrusion may be shaped substantially as a hemisphere or as a section of a sphere less than a hemisphere. In other words the protrusion may be approximately dome shaped. Alternatively, each protrusion may be shaped substantially as a semi cylinder or as a section of a cylinder less than a semi cylinder. Clearly, the recesses will have the complimentary shape.

In this case it is also important that the transition from the plane of the wall to the protrusion or recess be curved, again to prevent the shearing of the protrusion from the remainder of the filler material in the relevant compartment on application of a load.

A wall of a compartment may include one protrusion or recess, or may include two or more protrusions or two or more recesses, or a combination of protrusions and recesses.

Each compartment may have a single wall including a protrusion or a recess, or two or more or all of the walls including a protrusion or a recess.

Preferably, each wall of each compartment includes at least one protrusion or at least one recess.

The framework, i.e the tube and the dividing walls, may be made from any suitable flexible material. Although the material must possess some degree of flexibility, the degree of flexibility may range from very flexible up to semi rigid. The flexible material may be for example a plastics material such as for example a co-extruded or a biaxially extruded plastics material; a plastics laminate material such as for example a laminate of a plastics material and a metallic material or a textile material; a metallic material; a woven or non-woven textile material; a paper or cardboard material; and the like.

The flexible material is preferably a suitable plastics material.

The filler material may be any suitable filler material such as for example an inert filler material. e.g sand or gravel or the like, or a composition comprising a filler material and a settable binder therefor. Examples of such compositions include:

(i) an inert filler material such as sand or gravel or the like, and a cementitious binder, for example ordinary Portland Cement;

(ii) an inert filler material such as sand or gravel or the like and a bituminous binder;

(iii) a filler material such as soil treated with a suitable chemical composition such as calcium chloride, a lignin sulphonate or an ionic liquid to cause the soil to bind or set;

(iv) a filler material such as sand or gravel or the like and a resin binder, for example (a) a thermosetting resin such as polyurethanes and polyesters, (b) a thermoplastic resin such as polyethylene, EVA, or PVC, and (c) a suitable wax.

The settable composition may include a conventional foam or foaming agent so that the final set composition is a foamed composition, to reduce the weight thereof.

The filler material is preferably a fluid or paste which sets into a strong, rigid solid conforming to the geometry of the confining compartment walls.

The filler material preferably includes a binder such as a cementitious material, e.g the filler material may be a concrete material having a high slump value, in particular greater than 150, to which chemical additives have been added to aid setting.

The framework may have any suitable height and any suitable compartment size. For example, the height of the framework may range from 2 mm to 10 m inclusive, and each compartment may have a wall length of from 5 mm up to 2 m.

The compartments in the framework may have any suitable cross-section, such as square, hexagonal or octagonal, but preferably have a square cross-section. i.e each compartment is defined by four walls of substantially equal length.

The support structure may be made from a single framework as described above, or the support structure may be made from a plurality of frameworks laid side-by-side on the base, each framework being as described above and being filled with the filler material as described above. In this case, the compartments along an edge of a first framework will protrude into or be protruded into by the compartments along an adjacent edge of an adjacent framework, to interlock the frameworks one to another to form the support structure.

According to a second aspect of the invention there is provided a framework in use in forming a support structure on a base, the framework comprising a tube of a flexible material divided by dividing walls of a flexible material into an array of compartments or cells running the length of the tube, the compartments being arranged in rows and columns so that the tube divided by dividing walls has a honeycomb structure, a wall or walls of each compartment including one or more hollow protrusions or one or more hollow recesses or both, so that, in use, when the compartments are filled with a filler material, each hollow protrusion in a compartment wall fills with the filler material so that each compartment protrudes into or is protruded into by at least one adjacent compartment to interlock adjacent compartments.

BRIEF DESCRIPTION OF THE DRAWINGS

FIG. 2 is a partial perspective view of a section of a further framework according to the invention; and FIGS. 3A and 3B to 11A and 11B are cross sectional views of various compartment walls through the centre of the protrusions therein and side views of the same compartment walls, respectively.

DESCRIPTION OF EMBODIMENTS

Figure 1:
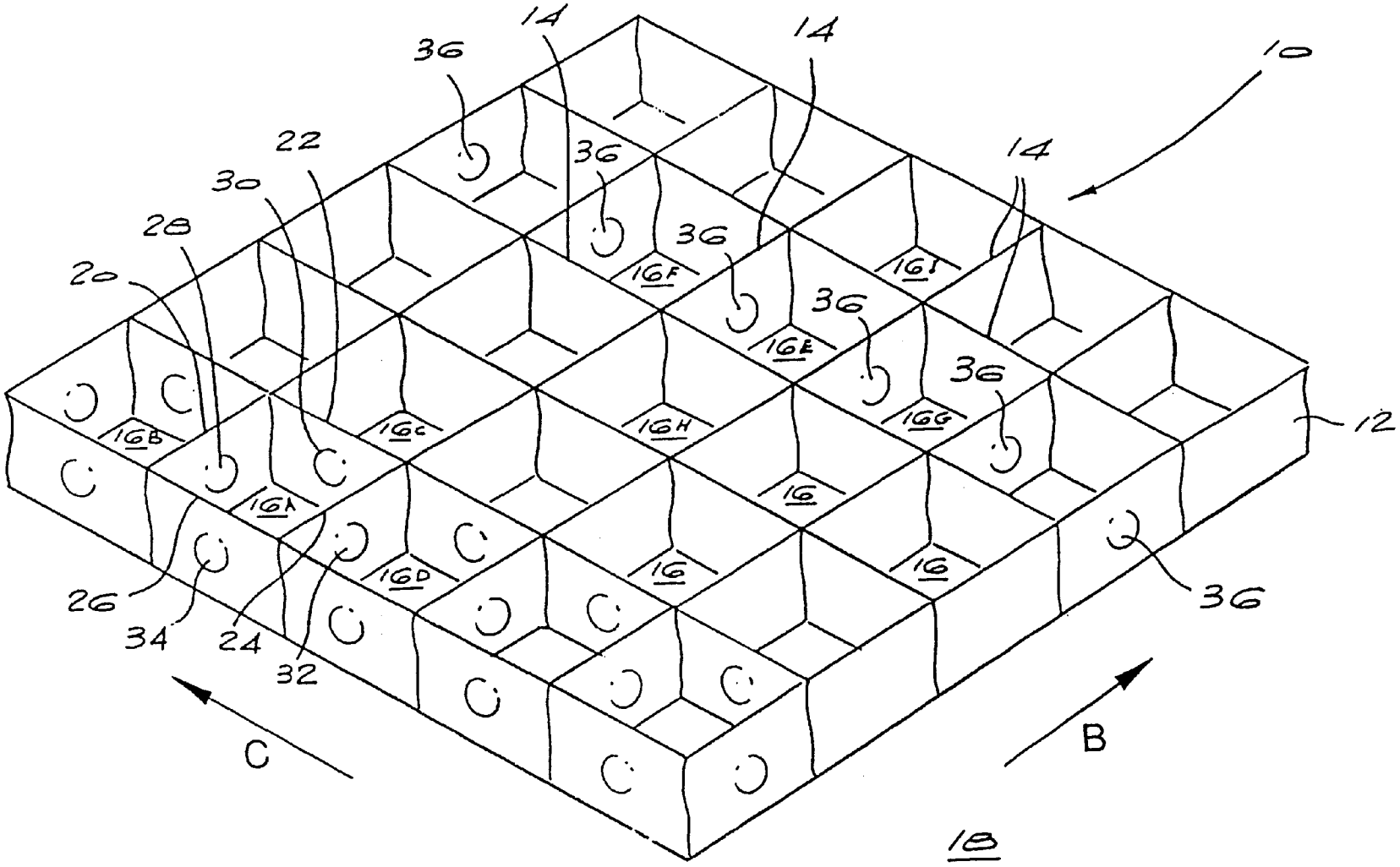
FIG. 1 is a schematic perspective view of a framework of the invention.

The first aspect of the invention is a method of forming a support structure on a base and this method will be described in more detail with reference to FIG. 1.

Referring to FIG. 1, there is shown a framework 10 comprising a tube 12 of a flexible material divided by dividing walls 14 of a flexible material into an array of compartments 16 running the length of the tube 12. The compartments 16 are arranged in rows running in the direction of the arrow B and columns running in the direction of the arrow C, so that the tube 12 divided by dividing walls 14 has a honeycomb structure as shown.

In a first section of the framework 10, each compartment 16 is defined by four walls. To illustrate this, we refer to the compartment 16A which is defined by walls 20, 22, 24 and 26. It can be seen that the wall 20 of compartment 16A also forms a wall of the adjacent cell 16B, the wall 22 of compartment 16A also forms a wall of the compartment 16C and the wall 24 of compartment 16A also forms a wall of the compartment 16D. The wall 26 of compartment 16A is an outside wall which may either be the outside wall of the support structure in use, or may abut an outside wall of an adjacent framework 10.

For compartment 16A, the wall 20 includes a protrusion 28 (which in turn is a recess in the compartment 16B), the wall 22 includes a protrusion 30 (which in turn is a recess in the compartment 16C), the wall 24 includes a recess 32 (which in turn is a protrusion in the compartment 16D) and the wall 26 includes a recess 34. When the compartment 16A is filled with the filler material, the compartment 16A will protrude into the compartments 16B and 16C and will be protruded into by compartment 16D and any adjacent compartment of an adjacent framework 10 abutting the wall 26.

In a second section of the framework 10, each compartment 16 is again defined by four walls, but only two of the four walls include protrusions or recesses 36. Thus, considering the compartment 16E, it protrudes into the adjacent compartment 16F and is protruded into by the adjacent compartment 16G, but does not protrude into or is not protruded into by the adjacent compartments 16H and 16I. Nevertheless, the compartment 16E is sufficiently interlocked with its neighbours to achieve the desired result, viz. an increase in the strength of the support structure of which the framework 10 forms a part. Further, when the protrusions 28, 30 32, 34 36, are rounded, they allow any load applied to the support structure of which the framework 10 forms a part, to be transferred across the support structure, and thus assist in preventing fracture or disintegration of the support structure, which in turn allows the support structure to accept greater loads.

The framework 10 is used to form a support structure on the base 18 as follows. Firstly, the framework 10 may be supported in position on the base in any suitable manner, for example by the use of flexible strings or rigid stays as is disclosed in our co-pending patent application.

Once the framework 10 is in position on the base 18, the compartments 16 are filled with a filler material so that the compartments 16 are adjacent to two or more other compartments 16 filled with the filler material, to support and be supported by the adjacent compartment 16. In addition, each protrusion 28, 30, 32, 34, 36 also fills with the filler material so that each compartment 16 protrudes into or is protruded into by at least one adjacent compartment 16 to interlock adjacent compartment 16.

As has been indicated, when each protrusion or recess is curved or rounded and each transition between the plane of the wall and the protrusion or recess is curved or rounded, this allows a degree of rotation between the blocks of filler material in adjacent compartments 16 during filling and setting of the filler material. This rotation allows the blocks of filler material in the adjacent compartment 16 to align so that the support structure so formed can receive a load which is then transferred across the support structure. The curved or rounded shape of each protrusion or recess and transition areas also prevents any shearing of the filler material in each protrusion or recess from the remainder of the filler material in a compartment 16 on application of a load.

The protrusions or recesses formed in the walls of the compartment 16 may take various shapes, some of which are illustrated in FIGS. 2 to 11.

Referring to FIG. 2, there is illustrated two compartments 40 of a framework, wherein the walls of the compartments 40 include a plurality of hollow pockets or bubbles 42. When a filler material is placed into the compartments 40, the filler material fills the pockets 42 which then press into the adjacent compartments 40 to cause the protrusion of one compartment 40 into an adjacent compartment 40 to cause, eventually interlocking of the compartments 40 in the final support structure.

Various other protrusion shapes are illustrated in FIGS. 3A and 3B to 7A and 7B. Referring to FIGS. 3A and 3B, a wall 50 of a compartment includes a protrusion 52 which is hemispherical in shape. From FIGS. 3A and 3B, it can clearly be seen that a protrusion 52 in a wall 50 of a first compartment also constitutes a recess in a wall 50 of a second adjacent compartment. It can also be seen that the transition from the plane of the wall 50 to the protrusion 52, illustrated at 53, is also curved, for the reasons stated above.

Referring to FIGS. 4A and 4B, a wall 54 of a compartment includes two protrusions 56. Again each protrusion 56 is hemispherical in shape.

Referring to FIGS. 5A and 5B, a wall 58 includes a recess 60 and a protrusion 62. Again the protrusion 60 and the recess 62 are hemispherical in shape.

Referring to FIGS. 6A and 6B a wall 64 includes a protrusion 66 which is shaped as a semi-cylinder which runs the width of the wall 64.

Referring to FIGS. 7A and 7B a wall 68 includes a protrusion 70 which is again is shaped as a semi-cylinder but which runs the height of the wall 68.

Referring to FIGS. 8A and 8B a wall 72 includes a protrusion 74 which is pyramidal in shape.

Referring to FIGS. 9A and 9B a wall 76 includes a protrusion 78 which is T-shaped in cross-section.

Referring to FIGS. 10A and 10B a wall 80 includes a protrusion 82 which is block shaped.

Referring to FIGS. 11A and 11B a wall 84 includes a protrusion 86 which is dovetail shape.

It is envisaged that many other types of protrusions and recesses may be designed, provided that the protrusions and recesses are of a sufficient size to ensure protrusion of one compartment into an adjacent compartment to provide interlocking.

In other words the filler material in the compartment must interlock with the filler material in the adjacent compartment to increase the strength of the support structure and to provide resistance against the filler material in one compartment from being pushed or pulled out of the compartment. The wall between two adjacent compartments acts as an expansion joint.

The protrusions or recesses in the walls of the compartments may be made in any suitable manner. For example, when the framework is made from a flexible material which is a plastics material, the necessary protrusions or recesses may be formed by heating a suitably shaped tool and then pressing the heated tool into the plastics material, or by vacuum moulding, or by pressing. Alternatively, when the flexible material of the framework is a woven or non-woven textile material, the necessary protrusions and recesses may be formed during manufacture of the textile material.

It has been found that a support structure made using a framework of the invention, i.e one including plurality of protrusions and recesses, can support a load which is up to 80% greater than an equivalent support structure made with a framework which does not include such protrusions or recesses.

As indicated above, generally when forming a support structure, a number of frameworks will be placed side-by-side on the base, and then each framework will be filled with a filler material as described. In this way, adjacent compartments of one framework may interlock with adjacent edge compartments of an adjacent framework, thus providing a support structure which posseses the desired features of the invention, viz. protrusion of adjacent compartments into one another to provide for interlocking and transfer of load.

The support structure formed according to the method of the invention may be for example a roadway or a paved area; a lining for a canal, river, drain or spillway or the like; a support for an embankment; a dam or harbour wall; or any other suitable support structure.

What is claimed is:

1. A method of forming a support structure on a base from a framework comprising a tube of a flexible material divided by dividing walls of a flexible material into an array of compartments running the length of the tube, the compartments being arranged in rows and columns so that the tube divided by dividing walls has a honeycomb structure, a wall or walls of each of the compartments including one or more hollow protrusions or one or more hollow recesses or both, the method comprising the steps of:

(1) locating the framework on the base;

(2) filling the compartments with a filler material so that each of the compartments is adjacent to two or more other compartments filled with the filler material to support and be supported by the adjacent compartments, and so that each of the hollow protrusions in each of the compartment walls fills with the filler material so that each of the compartments protrudes into or is protruded into by at least one of the adjacent compartments to interlock at least one adjacent compartment.

2. The method according to claim 1 wherein the framework is made from a flexible material selected from the group consisting of a plastics material, a plastics laminate material, a metallic material, a woven or non-woven textile material, or a paper or cardboard material.

3. The method according to claim 1 wherein the support structure is formed from a plurality of frameworks laid side-by-side on the base, the compartments along an edge of a first framework protruding into or being protruded into by the compartments along an adjacent edge of an adjacent framework, to interlock the frameworks to one another to form the support structure.

4. A framework for use in forming a support structure on a base, the framework comprising a tube of a flexible material divided by dividing walls of a flexible material into an array of compartments running the length of the tube, the compartments being arranged in rows and columns so that the tube divided by dividing walls has a honeycomb structure, a wall or walls of each of the compartments including one or more hollow protrusions or one or more hollow recesses or both, so that, in use, when the compartments are filled with a filler material, each of the hollow protrusions in each of the compartment walls fills with the filler material so that each of the compartments protrudes into or is protruded into by at least one adjacent compartment to interlock the adjacent compartments.

5. The framework according to claim 4 wherein each of the compartments has two or more of its walls including at least one protrusion or at least one recess.

6. The framework according to claim 4 wherein each of the compartments has all of its walls including at least one protrusion or at least one recess.

7. The framework according to any one of claims 4 to 6 wherein each of the protrusions or recesses is curved.

8. The framework according to claim 7 wherein each of the protrusions is shaped substantially as a hemisphere or as a section of a sphere less than a hemisphere.

9. The framework according to claim 7 wherein each of the protrusions is shaped substantially as a semi cylinder or as a section of a cylinder less than a semi cylinder.

10. The framework according to any one of claims 4 to 6 wherein each of the protrusions has a shape selected from a pyramid shape, a dovetail shape, a T-shape in cross section, and a block shape.

11. The framework according to claim 4 wherein the framework is made from a flexible material selected from the group consisting of a plastics material, a plastics laminate material, a metallic material, a woven or non-woven textile material, or a paper or cardboard material.

* * * * *